US008347987B1

(12) United States Patent
Seegmiller

(10) Patent No.: US 8,347,987 B1
(45) Date of Patent: Jan. 8, 2013

(54) APPARATUS AND METHOD FOR INSTALLING GROUND ANCHORING SYSTEMS

(76) Inventor: Ben L. Seegmiller, Salt Lake City, UT (US)

( * ) Notice: Subject to any disclaimer, the term of this patent is extended or adjusted under 35 U.S.C. 154(b) by 0 days.

(21) Appl. No.: 13/351,085

(22) Filed: Jan. 16, 2012

Related U.S. Application Data

(63) Continuation-in-part of application No. 13/233,613, filed on Sep. 15, 2011, which is a continuation-in-part of application No. 13/178,325, filed on Jul. 7, 2011, now Pat. No. 8,235,147.

(51) Int. Cl.
*E21B 10/32* (2006.01)
*E21B 7/28* (2006.01)

(52) U.S. Cl. ..... 175/292; 175/258; 175/291

(58) Field of Classification Search ..... 175/292, 175/291, 258
See application file for complete search history.

(56) References Cited

U.S. PATENT DOCUMENTS

| | | | | |
|---|---|---|---|---|
| 1,720,950 | A | 7/1929 | Edwards | |
| 1,794,735 | A | 3/1931 | Santiago | |
| 1,805,806 | A | 5/1931 | Campbell et al. | |
| 1,828,750 | A | 10/1931 | Raymond | |
| 1,856,579 | A | 5/1932 | Mitchell et al. | |
| 2,382,725 | A | 8/1945 | Koppl et al. | |
| 2,879,038 | A * | 3/1959 | Johnson | 175/291 |
| 4,036,026 | A * | 7/1977 | Asayama | 405/262 |
| 4,046,205 | A * | 9/1977 | Asayama | 175/292 |
| 5,219,246 | A * | 6/1993 | Coutts et al. | 405/237 |
| 5,934,394 | A * | 8/1999 | Fareham | 175/292 |
| 6,607,046 | B1 | 8/2003 | Betts et al. | |
| 7,686,103 | B2 * | 3/2010 | Pile | 175/292 |

* cited by examiner

*Primary Examiner* — Giovanna Wright
(74) *Attorney, Agent, or Firm* — Morriss O'Bryant Compagni, PC

(57) ABSTRACT

An apparatus and method for forming a borehole in an earthen formation includes a side cutting device comprised of a laterally extendable side cutting element that can be actuated from a retracted position to an extended position in which the side cutting element is selectively employed to create a larger borehole diameter in a down hole location than the remaining portion of the borehole that is closer to the borehole opening.

24 Claims, 13 Drawing Sheets

(Section A-A)

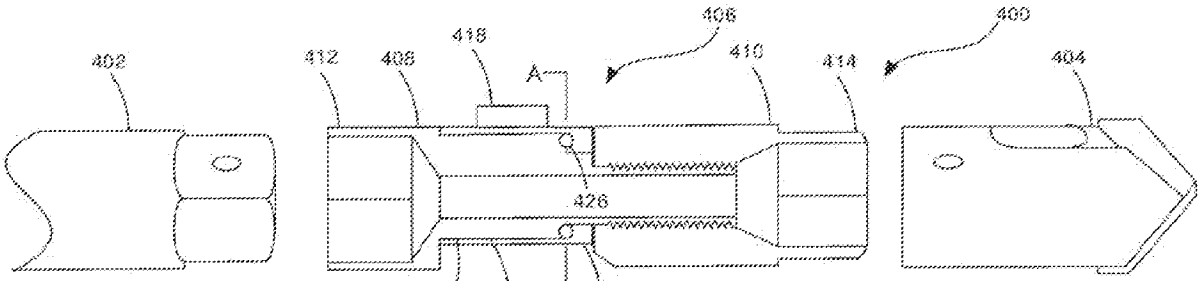
FIG. 11A
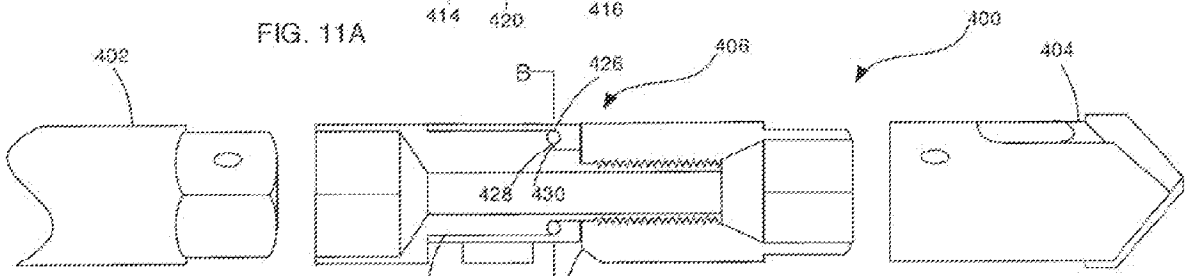
FIG. 11B
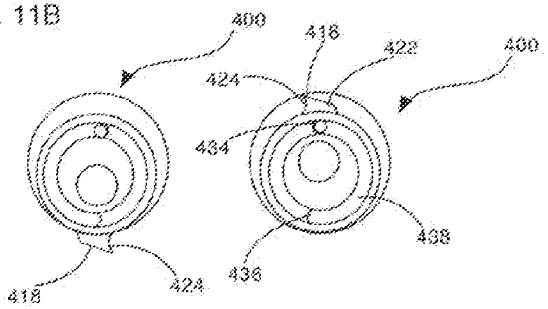
FIG. 11C
(Section A-A)
FIG. 11D
(Section B-B)

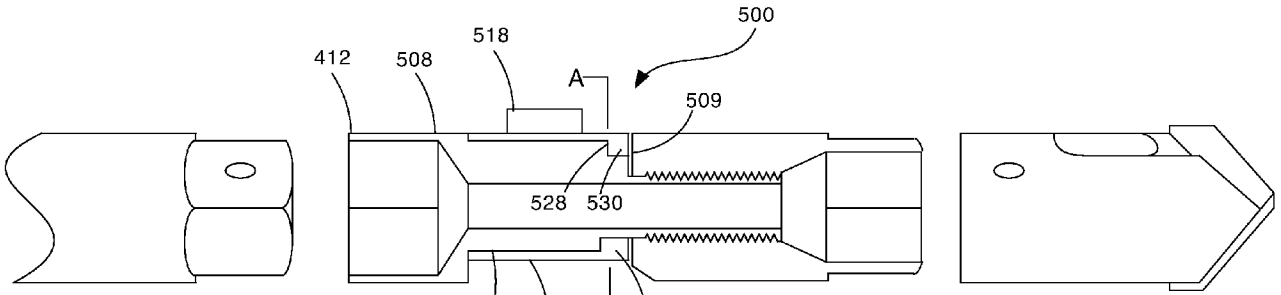
FIG. 12A
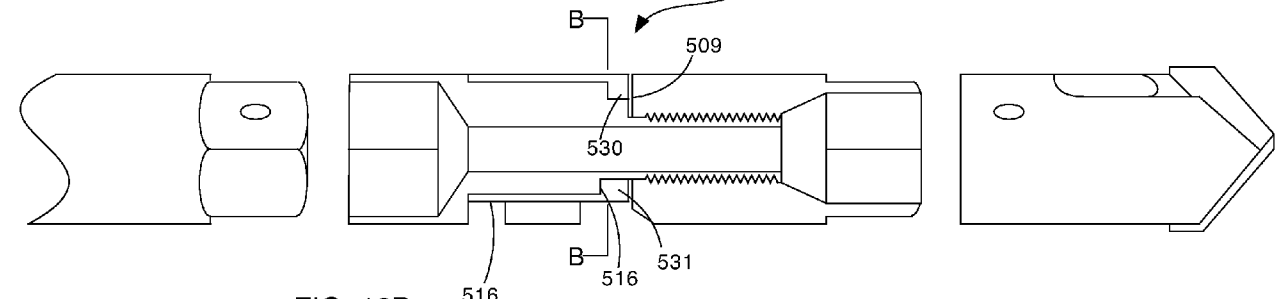
FIG. 12B
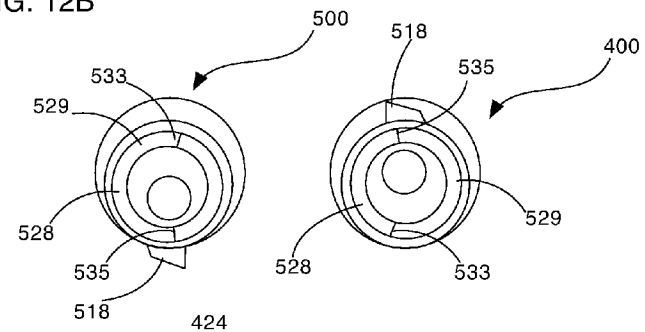
FIG. 12C
(Section A-A)
FIG. 12D
(Section B-B)

(Section A-A)

(Section A-A)

(Section C-C)

(Section A-A)

(Section B-B)

APPARATUS AND METHOD FOR INSTALLING GROUND ANCHORING SYSTEMS

CROSS-REFERENCE TO RELATED APPLICATIONS

The present application is a continuation-in-part of and claims priority to U.S. patent application Ser. No. 13/233,613 filed on Sep. 15, 2011, which is a continuation-in-part of U.S. patent application Ser. No. 13/178,325 filed on Jul. 7, 2011, the entirety of each of which is incorporated by this reference.

BACKGROUND OF THE INVENTION

1. Field of the Invention

The present invention relates generally to ground anchoring systems, and more specifically, to methods and devices used to drill boreholes in rock strata or other earthen formations for ground anchoring systems.

2. State of the Art

There are various situations where it is critical for safety reasons to maintain the integrity of rock formations or to provide secure anchoring of rock bolts and the like. Such situations may be where earth has been excavated that create a steep inclined wall, tunnelling or in underground mining where the ceiling or roof needs to be secured to prevent a cave-in or even large chunks of rock from falling on workers. In addition, there are situations where the ground is used as an anchoring point to which a cable or other structure in tension must be attached. In such situations, a borehole is drilled and an anchoring system is installed.

In underground mining, a system of roof bolts is used to secure the roof and walls of a mine shaft so that they are self-supporting. According to U.S. law, many underground coal mine entries must be roof bolted. In order to increase the speed by which the roof is bolted, roof bolting machines have been developed. Currently, such roof bolters include hydraulically driven miner-mounted bolting rigs that can be maneuvered in a mine opening and that includes one or more drilling stations for installing roof bolts.

A roof bolting machine works by drilling directly into the rock strata with a rock boring drill bit and inserting either conventional bolts, resin roof bolts or cement grouted roof bolts. These machines use bidirectional type drills that are capable of drilling holes into the rock strata of a depth from about four feet to twelve feet. In addition, the machines are used to insert and, in some applications, tighten and tension the roof bolts that are inserted into the predrilled boreholes.

More modern roof bolting machines are automated to remove the risk of having the operator be exposed to falling rock while the roof bolting procedure is being performed. Such roof bolting machines are operated via remote control from a safer position located away from the unsupported roof area. They use the same technique, however, of drilling a borehole, inserting a resin or cement grout cartridge, inserting a roof bolt and spinning the roof bolt to mix the resin or grout until the resin or grout hardens. The roof bolts may be installed in an untensioned or tensioned state, depending on the particular bolting method being employed.

There are primarily two types of roof bolts used in underground mining. In both instances, boreholes are drilled into the roof and/or walls. Long steel rods are inserted into the boreholes and retained in one of two ways. Point anchor bolts or expansion shell bolts are one type of roof bolt. The anchor bolt is typically between about ¾ to 1 inch in diameter and between about 3 and 12 feet in length. An expansion shell is positioned at the end of the bolt that is inserted into the hole. As the bolt is tightened, the expansion shell expands and causes the bolt to be retained within the hole. These types of bolts are considered temporary because corrosion will reduce the life span of such roof bolts. In addition, because they are only secured by the expansion shell, a layer of closely jointed or soft rock at the expansion shell could allow the expansion shell and the roof bolt to move relative to the hole. This can create a dangerous environment, especially in areas where such rock formations are prevalent.

As such, all underground coal mines in the U.S. use some form of resin or cement grouted roof bolts. One such resin grouted roof bolt is comprised of a length of rebar. The rebar is of a similar size to the anchor bolt previously described, but is not provided with an expansion shell. Rather, after drilling the hole, an elongate tube (cartridge) of resin is inserted into the hole. The rebar is then installed after the resin and spun by the installation drill. This opens the resin cartridge and mixes the resin components. The proximal end of the rebar includes a head that engages a roof plate when fully inserted into the borehole. For tensioning applications, the rebar may include an exposed threaded end for receiving a threaded nut that can be tightened against a roof plate, which in turn is pressed against the roof thus holding the rock strata together. Such tensioning applications usually require a point anchor at the distal end of the rebar. In such applications, an expansion shell system may be used in combination with a resin or cement grout to provide a point anchor at the distal end and to allow tensioning of the roof bolt. In other untensioned applications, the rebar is simply inserted with the resin or cement grout and spun for a few seconds. The resin or grout is allowed to cure with the rebar inserted. Such resin or cement grouted rebar is considered a more permanent form of roof support with a potential lifespan in excess of twenty years, since the resin or cement grout help prevent corrosion of the rebar. Long sections of cable have also been employed in place of conventional roof bolts. They are installed in a similar manner to conventional resin or cement grouted roof bolts, but may have significantly longer lengths. Even with the resin or cement hardened around the roof bolt, in some underground mines where the rock strata is unstable, or mostly comprised of closely jointed rock or soft rock, the roof bolt can be relatively easily dislodged from the borehole in which it has been inserted. This may occur even when the bolt is tensioned during the installation process or later and without warning when the result could create a potentially serious safety threat. In such environments, current methods of roof bolt installation do not provide any way to increase the load bearing capability of each roof bolt. In other words, if a roof bolt is imbedded in soft or highly fragmented rock formations, there may be no way to know if the roof bolt is going to hold and there is nothing that can help prevent the roof bolt from failing.

As such there is a significant need in the art to provide a method for installing ground anchors, such as roof bolts, that ensures that the ground anchor will be adequately secured to the ground even in conditions of closely jointed or soft rock. There is also a need to provide such a method for installing ground anchors that does not add any significant amount of time to the anchor installation process. In addition, there is a need in the art to provide a method for installing a ground anchor that is easy to follow and consistently produces the desired result of ensuring that the ground anchor will properly perform even in ground conditions that are not conducive for such anchoring system installations.

SUMMARY OF THE INVENTION

Accordingly, the present invention provides an apparatus and method of using the apparatus to drill holes into earthen formations that creates a wider diameter down hole than the diameter of the hole at the point of entry. In other words, the apparatus of the present invention is capable of creating a hole having two different diameters, with a wider diameter portion being down hole of a narrower diameter portion. The apparatus is configured to work with conventional drill bits used for drilling rock formations, such as when installing rock or roof bolts in underground mining situations, but could be adapted for other situations, such as when anchoring tension cables to rock formations.

In one embodiment an apparatus for forming a borehole in an earthen formation is comprised of a drill bit having a distal cutting end and a proximal end configured for coupling. A side cutting apparatus is comprised of a first end configured for coupling to the drill bit and a second end configured for coupling to a drill stem. A first cam structure has at least one groove formed therein with the groove being laterally radially offset relative to the first cam structure. At least one cutting element having a base portion is at least partially disposed within the groove and includes a cutting portion depending from the base portion that radially extends from the first cam structure. A second cam structure is positioned adjacent to the first cam structure for retaining the at least one cutting element within the groove. An inner sleeve is rotatably coupled to one of the first cam structure and the second cam structure and fixedly coupled to the other of the first cam structure and the second cam structure. Rotation of the drilling stem in a first direction causes the at least one cutting element to be in a first retracted position relative to the outer sleeve and rotation of the drilling stem in a second direction causes the first cam structure to rotate relative to the second cam structure to thereby force the at least one cutting element to move along the groove to a second extended position.

In another embodiment, the first cam assembly includes a pair of grooves, each groove being laterally radially offset relative to the first cam structure and in an opposite direction to the other groove.

In another embodiment, the base portion of the cutting element is comprised of one of a pin, an arcuate plate and a semispherical ball.

In still another embodiment, the second cam structure defines at least one recess in a face thereof that faces the first cam structure. At least a portion of the base portion of the cutting element is positioned within the recess. The recess has a width substantially similar to a width of the base portion inserted therein and a length sufficient to allow the base portion to translate within the recess as the base portion moves along the groove.

In yet another embodiment, an outer sleeve is positioned over an interface between the first cam structure and the second cam structure and has at least one aperture formed in a sidewall thereof. The cutting portion of the cutting element extends through the aperture at least when in the second extended position.

In another embodiment, the first and second cam structures are in a fixed relation to each other. The second cam structure includes a corresponding groove to the groove in the first cam structure. The outer sleeve is fixedly coupled relative to one of the first cam structure and the second cam structure so as to rotate therewith.

In still another embodiment, the outer sleeve is integrally formed with the first cam structure and the second cam structure fits at least partially within the outer sleeve.

In another embodiment, an apparatus for forming a borehole in an earthen formation comprises a side cutting assembly having a first body portion with a first end configured for coupling to a drill bit and a central vacuum bore and a second body portion coupled to the first body portion having a second end configured for coupling to a drill stem. Either the first body portion or second body portion has a nonconcentric cylindrical portion with a diameter that is less than a diameter of the first body portion proximate the first end thereof. A sleeve disposed on the nonconcentric cylindrical portion is partially rotatable relative thereto between a first position and a second position. At least one cutting element is disposed on the outer surface of the sleeve so that when the sleeve is in the first position, the at least one cutting element is in a retracted position and when the sleeve is in the second position the at least one cutting element is in an extended position for cutting a sidewall of a borehole to enlarge a diameter of the borehole while the at least one cutting element is in the extended position.

In yet another embodiment, the at least one cutting element has a leading edge that is spaced radially farther from the longitudinal axis of the first body than a trailing edge of the at least one cutting element to cause the at least one cutting element to engage the sidewall of the borehole when the drill bit is reversed to cause the sleeve to rotate relative to the first body from the first position to the second position.

In another embodiment, the cutting element engages the sidewall of the borehole when the drill bit is reversed to cause the sleeve to rotate relative to the first body from the first position to the second position and to force the at least one cutting element into further engagement with the sidewall of the borehole. The sleeve is freely rotatable approximately one hundred eighty degrees between the first position and the second position.

In another embodiment, the apparatus includes a first semicircular groove in an inner lateral surface of the sleeve and a second semicircular groove in an outer surface of the first body. A spherical bearing is disposed within the first and second semicircular grooves whereby rotation of the sleeve relative to the first body is limited by engagement of the spherical bearing with respective ends of the first and second semicircular grooves.

In still another embodiment, the apparatus includes a groove in an inner surface of the sleeve and a protrusion extending from an outer surface of the body whereby rotation of the sleeve relative to the body is limited by engagement of the protrusion with ends of the groove.

The present invention also includes a method for forming a borehole in an earthen formation comprising providing a drill bit assembly in accordance with the principles of the present invention. First, the drill bit assembly is rotated in a first direction to drill a borehole in an earthen formation with the at least one cutting element in a first retracted position. Next, the drill bit assembly is rotated in a second direction to rotate the first cam structure relative to the second cam structure, thereby forcing the cutting element to move along the groove to a second extended position. As the drill bit assembly is rotating in the second direction, the drill bit is retracted a certain distance from the borehole to form an enlarge borehole portion in a down hole location. Rotation of the drill bit assembly back in the first direction causes the cutting element to retract to the first retracted position. The drill bit assembly can them be removed from the borehole. This creates an enlarged diameter portion in the borehole at a down hole location.

In another embodiment, the invention includes a method for forming a borehole in an earthen formation for an anchoring system that comprises rotating a drill bit in a first direction, drilling a borehole having a first diameter into an earthen formation to a first down hole position of a depth sufficient to receive a portion of an anchoring system, maintaining the drill bit in the first down hole position while rotating the drill bit in a second direction opposite to the first direction to cause a side cutting element to engage a sidewall of the borehole proximate the first down hole position, moving the drill bit to a second down hole position that is closer to an opening of the borehole than the first down hole position while rotating the drill bit in the second direction to cause the side cutting element to increase the first diameter of the borehole to a second diameter between approximately the first down hole position and the second down hole position, reversing the rotation of the drill bit back to the first direction to cause the side cutting element to disengage the sidewall of the borehole, and removing the drill bit from the borehole.

BRIEF DESCRIPTION OF THE DRAWINGS

The foregoing summary, as well as the following detailed description of the illustrated embodiments is better understood when read in conjunction with the appended drawings. For the purpose of illustrating the invention, there is shown in the drawings several exemplary embodiments which illustrate what is currently considered to be the best mode for carrying out the invention, it being understood, however, that the invention is not limited to the specific methods and instruments disclosed. In the drawings:

FIGS. 11A, 11B, 11C and 11D are cross-sectional side views of another embodiment of a drill bit and a drill bit adapter in accordance with the principles of the present invention.

FIGS. 12A, 12B, 12C and 12D are cross-sectional side views of yet another embodiment of a drill bit and a drill bit adapter in accordance with the principles of the present invention.

DETAILED DESCRIPTION OF THE ILLUSTRATED EMBODIMENTS

Figure 1:
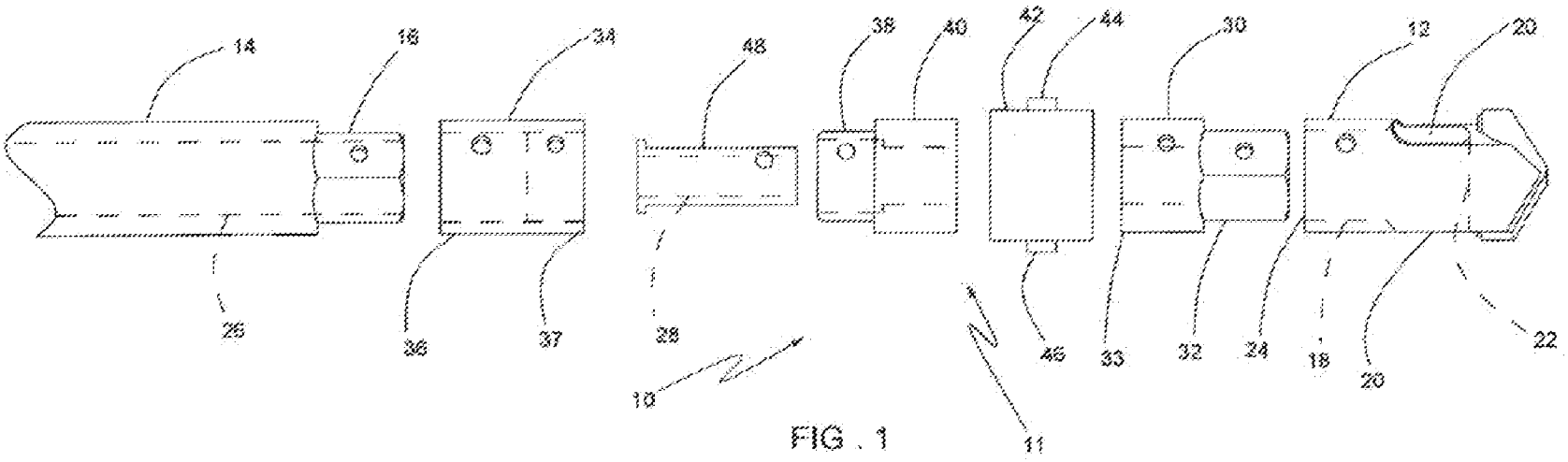
FIG. 1 is an exploded side view of a first embodiment of a drill bit and a drill bit adapter in accordance with the principles of the present invention.

FIG. 1 is side view of a first embodiment of a drill assembly, generally indicated at 10, configured for enlarging a borehole diameter in a down hole position according to the principles of the present invention. The drill assembly 10 is configured to work with a conventional rock drilling bit 12 and drill stem 14. In a conventional configuration, the drill bit 12 is directly coupled to the drill rod or stem 14 (commonly referred to as the "drill steel") with the hexagonal end 16 of the drill stem inserted into the corresponding hexagonal opening in the drill bit 12. The drill bit 12 is provided with transversely extending side vents 20 that extends transversely through a central portion 22 of the drill bit 12 and are in fluid communication with a longitudinal bore 18 that extends from an open proximal end 24 of the drill bit 12 to the side vents 20. The drill stem 14 also includes a longitudinally extending bore 26 that when coupled to the bit 12 provides a continuous duct through which debris from a drilling process can be vacuum pulled through the vent 20 along the bore 26 and to a collection bin in the drilling machine (not shown) in order to reduce the amount of drilling dust that exits the borehole being drilled with the bit 12.

The drill assembly 10 is configured with a longitudinally extending bore 28 that when the parts are assembled that extends from the bit 12 through the drill stem 14 so as to allow the aforementioned debris to be drawn through the drill assembly 10 during the drilling process as previously described. The drill assembly 10 includes a side cutter assembly 11 that includes a first cam component 30 configured for attachment to the drill bit 12. Thus, the distal end 32 of the component 30 is configured to fit within the proximal end 24 of the bit 22. The proximal end 33 is provided with a first set of cam features therein. A drill stem attachment component 34 has a proximal end 36 configured for attachment to the hexagonal end of the drill stem 16 and a distal end 37 configured for attachment to a proximal end 38 of a second cam component 40. The first and second cam components form camming surfaces (not visible). An exterior sleeve 42 that holds a pair of laterally extendable cutters 44 and 46 is configured to fit over the first and second cam components 30 and 40. An internal sleeve 48 is configured to fit within and abut against the second cam component and be fixedly coupled to the first cam component 30. This allows the first cam component 30 to rotate to a certain degree relative to the second cam component 40. In other words, the second cam component can swivel about the internal sleeve 48 in either direction to a limited degree. In operation, as will be described in more detail herein, engagement of the cam features of the cam component 30 and 40 along with relative rotation of the first cam component 30 relative to the second cam component 40 will cause the cutters 44 and 46 to extend or retract laterally relative to the sleeve 42 depending on the direction of rotation of the bit 12 relative to the stem 14.

Figure 2:
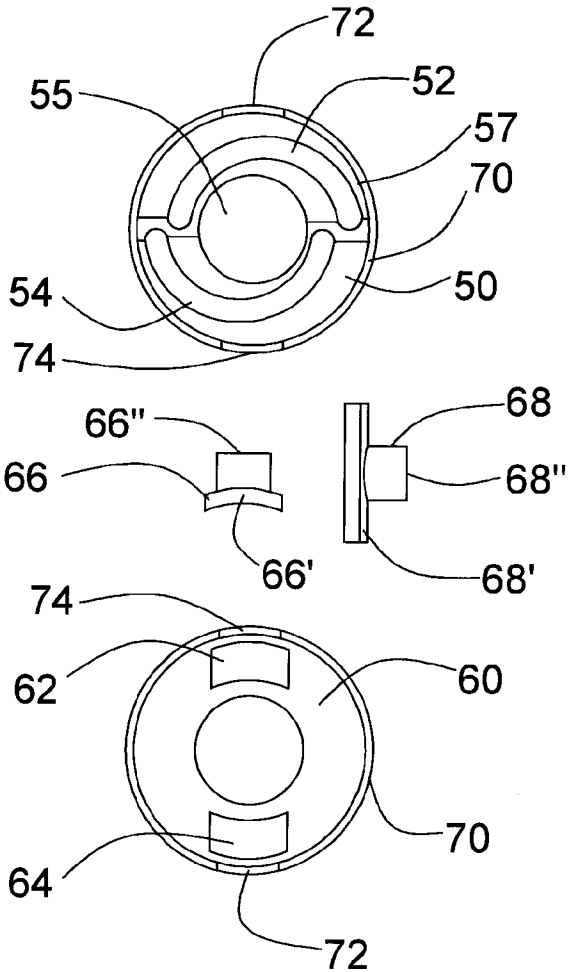
FIG. 2 is a top and bottom view, respectively, of one embodiment of a pair of cam components in accordance with the principles of the present invention.

As will be discussed throughout, the cam components and cutters may have various configurations. For example, as shown in FIG. 2, a first cam component 50 is provided with first and second cam grooves 52 and 54. The cam grooves 52 and 54 are oppositely oriented on opposite halves of the cam component 50. The cam grooves are radially offset so that each groove 52 and 54 has a beginning point and end point that are at different radial positions with each groove 52 and 54 having a radius along the center of the groove that is approximately equal to a radius of the cam component 50 at a position midway between the central aperture 55 and the outer circumferential surface 57. In other words, the mean radius of each groove is approximately equal to the radius at the midpoint between the aperture 55 and the outer surface 57. In addition, each groove 52 and 54 has a semi-circular contour. Each groove 52 and 54 is transversely offset relative to a diameter of the cam component and in opposite directions. As such, they are not mirror images of one another, but rather 180 degree rotations of each other. In the second cam component 60, first and second, oppositely oriented recesses 62 and 64 are formed therein. First and second cutters 66 and 68, each include a base portion 66' and 68' and a cutter portion 66" and 68" extending therefrom. The base portions 66' and 68" are configured with one side to fit in a respective cam groove and the other side to fit within a respective one of the recess 62 and 64 when the first and second cam components 50 and 60 are brought together. The sleeve 70 that surrounds the cam components 50 and 60 is provided with apertures 72 and 74 sized to receive a respective one of the cutters 66 and 68. The outer sleeve 70 is configured to be fixedly coupled to the cam component 60, but rotatable relative to the cam component 50. As the sleeve 70 rotates, the engagement of the bases 66' and 68' of the cutters 66 and 68 with the grooves 52 and 54, respectively, causes the cutters to be laterally displaced relative to the sleeve 70 as the bases 66' and 68' slide along the grooves 52 and 54 to cause the cutters 66 and 68 to protrude from the sleeve 70 or retract within the sleeve 70. In so doing, the base portions 66' and 68' of the cutters 66 and 68 slide linearly within the recesses 62 and 64 that are sized to fit the base portions 66' and 68'. It should be noted that while the various embodiments shown and described herein include a pair of cam grooves and a corresponding pair of cutters arranged directly transverse to one another, the side cutting apparatus of the present invention could be formed with a single groove and a single side cutter or multiple cutters arranged in multiple cam assemblies that are stacked one on top of the other in accordance with the principles of the present invention.

Figure 3:
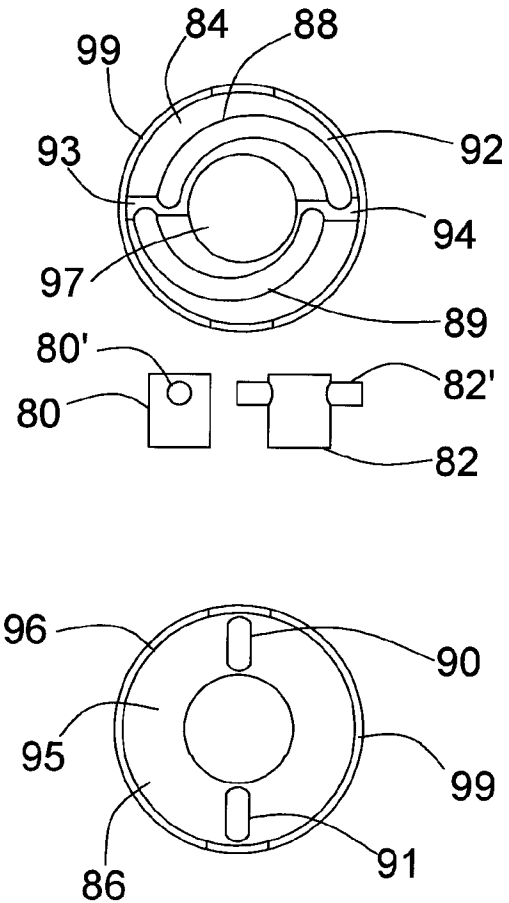
FIG. 3 is a top and bottom view, respectively, of another embodiment of a pair of cam components in accordance with the principles of the present invention.

FIG. 3 illustrates a similar configuration to that of FIG. 2 with differently configured side cutters 80 and 82 and cam components 84 and 86. The cutters 80 and 82 are provided with laterally extending cylindrical arms or pins 80' and 82' that are sized to engage a respective cam groove 88 or 89 on one side and recesses 90 and 91 formed in cam component 86 on the other side. The face 92 of the cam component 84 is provided with raised portions 93 and 94 to abut against the surface 95 of cam component 86. This creates lateral stability between the components 84 and 86 as they rotate and slide relative to each other in order to cause lateral displacement of the cutting elements 80 and 82 relative to the sleeve 96 as described with reference to FIG. 2. Because of the engagement of the pins 80' and 82' with a respective groove 88 and 89, the cam components 84 and 86 can rotate relative to each other a limited amount. In this embodiment, the relative rotation is slightly less than 90 degrees. However, over that angular rotation, the pins 80' and 82' can move from near the center aperture 97 to the outside edge of the cam component 84. This will cause lateral displacement of the cutters 80 and 82 relative to the sleeve 99 of the distance between the radius of the component 84 to the center of the groove 88 at its point nearest the center of the component 84 and the radius of the component 84 to the center of the groove 88 at its point farthest from the center of the component 84. Given that the diameter of the component 88 may be only 1.25 inches (3.2 mm) for a roof bolt application, the lateral displacement of each cutter 80 and 82 may be about 2 to 4 mm, resulting in an increase in diameter of the borehole of 4 to 8 mm.

Figure 5:
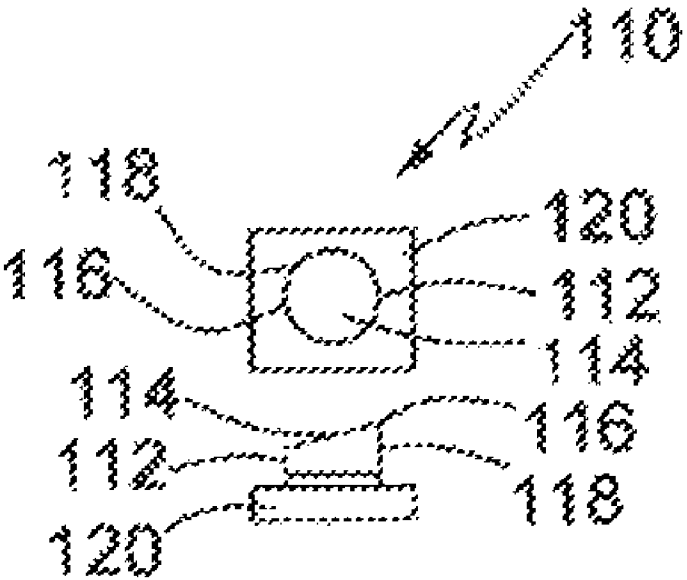
FIG. 5 is a side and front view of another embodiment of a cutting element in accordance with the principles of the present invention.
Figure 4:
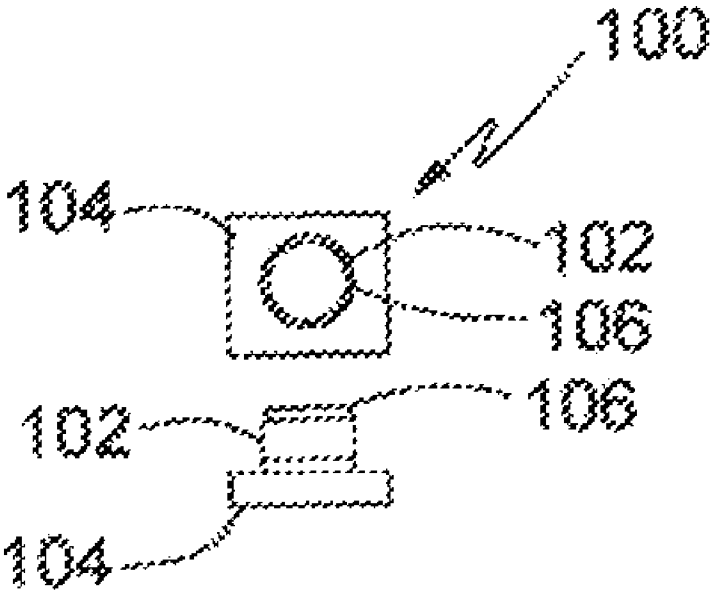
FIG. 4 is a side and front view of one embodiment of a cutting element in accordance with the principles of the present invention.

As illustrated in FIGS. 4 and 5, the individual cutting elements may have different configurations and may be in a form similar to diamond cutting elements used on earth boring drill bits, such as rotary drag bits. The cutting element 100 is predominantly comprised of a diamond cutting structure 102 attached to a base structure 104. The leading or exposed edge 106 of the diamond cutting structure is beveled to increase the integrity of the cutting structure and to help prevent breakage of the cutting element at this edge. The cutting element 110 shown in FIG. 5 is similarly configured with a diamond cutting structure 112, but the cutting structure includes a tapered top surface 114 to provide a sharpened leading edge 116 defining an acute angle between the surface 114 and the front side 118 of the cutting structure 112. Again, the cutting structure is attached to the base 120. When positioned within a cutting apparatus according to the principles of the present invention, the leading edge 116 is oriented so that when the cutting structure 112 is extended and positioned for cutting, the leading edge 116 is oriented toward the direction of rotation so that the cutting is achieved by this sharpened leading edge 116. The cutting structure 112 is bonded to the base 120 by methods known in the art. The cutting structure 112 may also be formed from tungsten carbide or other materials known in the art for their cutting properties.

Figure 6:
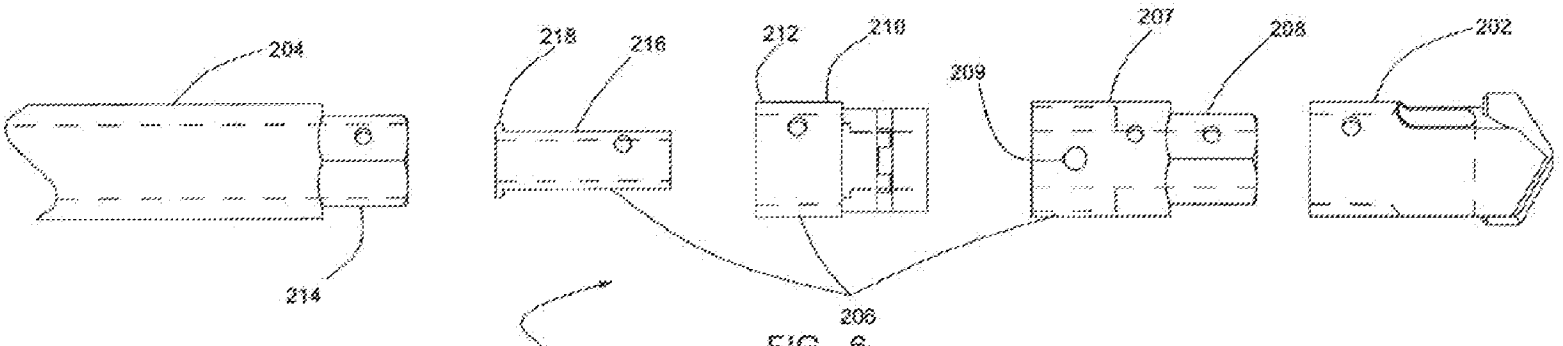
FIG. 6 is an exploded side view of a third embodiment of a drill bit and a drill bit adapter in accordance with the principles of the present invention.

FIG. 6 illustrates another embodiment of an earth boring drill assembly 200 in accordance with the principles of the present invention. The drill assembly 200 includes a standard drill bit 202 and standard drill stem 204. Interposed between the drill bit 202 and drill stem 204 is a selectively actuated bore enlarging cutting device 206 that forms an adapter between the drill bit 202 and the drill stem 204. The cutting device 206 is comprised of an outer housing component 207 configured at one end 208 for attachment to the drill bit 202, a cam assembly 210 having one end 212 configured for mating with the distal end 214 of the drill stem 204 and an inner sleeve 216 having a retaining rim 218 at one end to abut against an inside surface of the cam assembly 210. The inner sleeve 216 has a length sufficient to pass through the cam assembly 210 and be attached to the outer housing 207. The cam assembly can thus freely rotate a limited degree within the outer housing 207 in either direction.

Figure 6A:
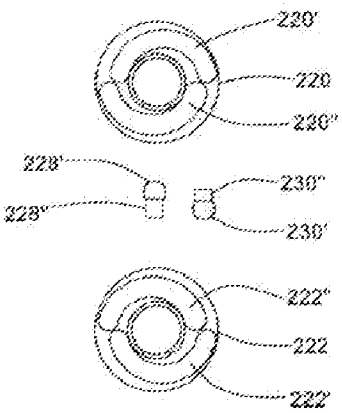
FIG. 6A is a top view of the components of a cam mechanism illustrated in FIG. 6.

As shown in FIG. 6A, the cam assembly 210 is comprised of a first cam member 220 and a second cam member 222 that are configured with corresponding cam grooves 220', 220", 222' and 222". The center portions 224 and 226 of each cam member 220 and 220 are provided with respective mating raised and recessed surfaces so that when the two cam members 220 and 222 are brought together, their relative rotational orientation is maintained. In this way, groove 222' will be positioned directly above groove 220' and groove 222" will be positioned directly above groove 220". Thus, the respective grooves work in tandem to guide a cutting element therein. The cutting elements 228 and 230 are each comprised of a semispherical base portion 228' and 230' and an attached cylindrical cutting element 228" and 230". The cutting elements each protrude through an aperture 209 in the outer sleeve member 207. As the sleeve 207 rotates relative to the cam assembly 210, the base portions 228' and 230' slide or roll along their respective groove set 220' and 220" or 222' and 222". This causes the cutting portions 228" and 230" to extend or retract relative to the sleeve 207.

Figure 7B:
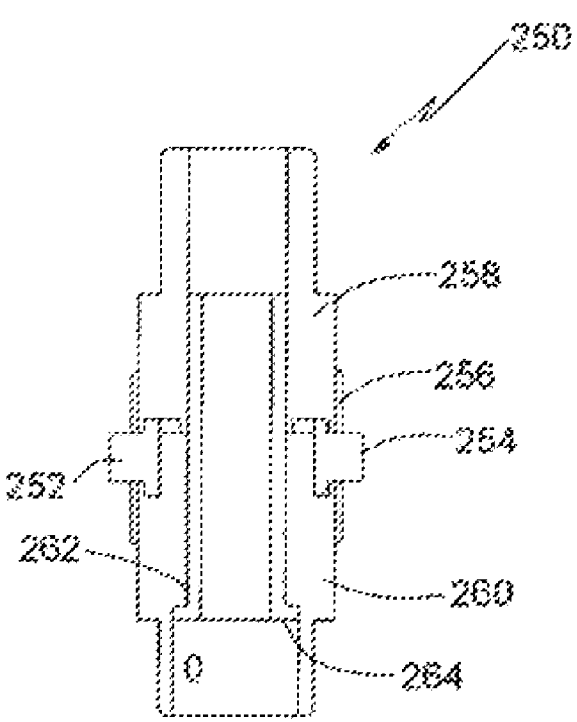
FIGS. 7A and 7B are cross-sectional side views of yet another embodiment of a side-cutting adapter in accordance with the principles of the present invention.
Figure 7A:
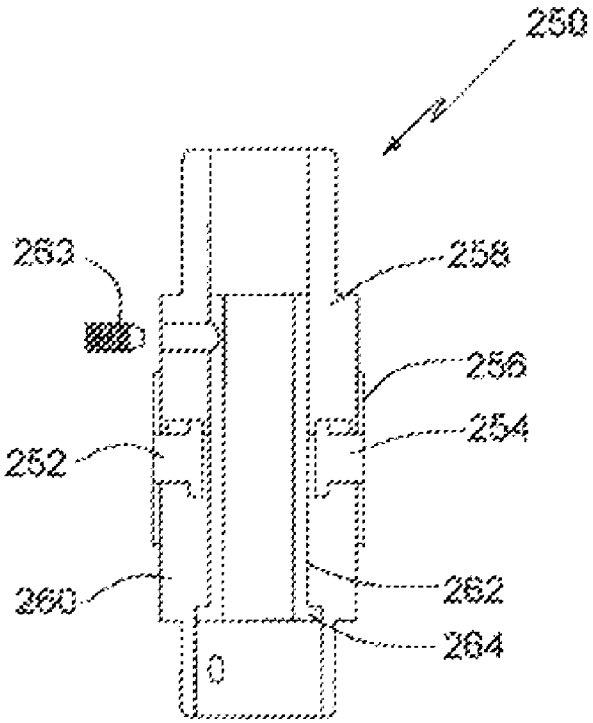

As shown in FIGS. 7A and 7B, a side cutting bit adapter, generally indicated at 250, is capable of extending and retracting laterally extendable side cutters 252 and 254 from a retracted position shown in FIG. 7A where the outermost surface of each side cutter 252 and 254 is substantially flush with an outer sleeve 256 to a second extended position shown in FIG. 7B where at least a portion of each cutter 252 and 254 extend outwardly from the sleeve 256. This lateral movement of the side cutters 252 and 254 is actuated by rotational movement of the upper cam member 258 relative to the lower cam member 260. The upper cam member 258 is rigidly mounted to the inner sleeve 262, as with a setscrew 263 while the lower cam member 260 abuts against the proximal end 264 of the sleeve 262 but can freely rotate relative to the inner sleeve 262 and the upper cam member 258. This allows the upper cam member 258 to be rotated relative to the lower cam member 258 from a first position in which the cutting elements 252 and 254 are in a retracted state to a second position, as shown in FIG. 7B, in which the cutting elements 252 and 254 are fully extended. Reversing the direction of the drill to which the adapter 250 is attached will reverse the movement of the cutting elements 252 and 254. As the lower cam member 260 is rotated in a clockwise direction, the base portions of the cutting elements 252 and 254 that engage corresponding grooves in the lower cam member slide along the grooves. The upper cam member 258 is provided with recesses that allow for lateral movement of the cutting elements 252 and 254 relative thereto, but that prevents any substantial movement of the cutting elements 252 and 254 in a rotational direction relative to the upper cam member 258. In essence, the upper cam member 258 forms an abutment to prevent rotational movement of the cutting elements 252 and 254 relative to the upper cam member 258 while allowing the cam members to move laterally. The outer sleeve 254 is retained on the outer perimeter surfaces of the upper and lower cam members 258 and 260 by the engagement of the cutting elements 252 and 254.

Figure 8B:
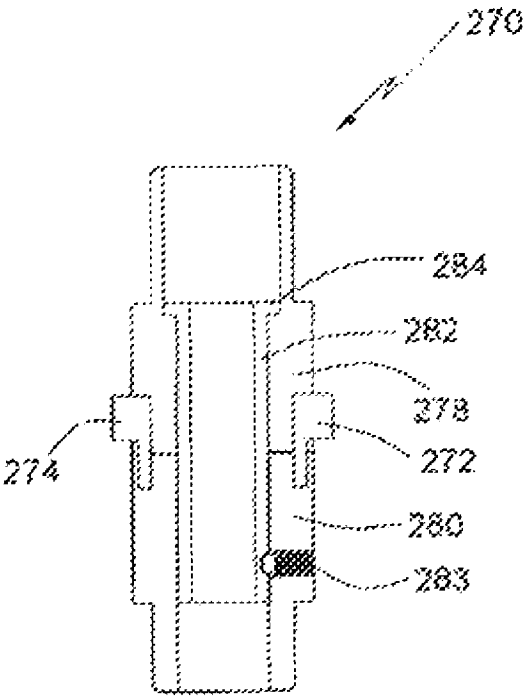
FIGS. 8A and 8B are cross-sectional side views of yet another embodiment of a side-cutting adapter in accordance with the principles of the present invention.
Figure 8A:
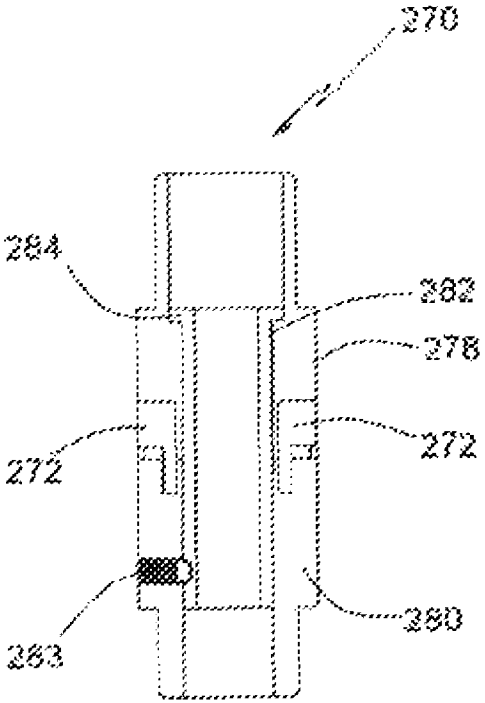

As shown in FIGS. 8A and 8B, a side cutting bit adapter, generally indicated at 270, is capable of extending and retracting laterally extendable side cutters 272 and 274 from a retracted position shown in FIG. 8A to a second extended position shown in FIG. 8B where at least a portion of each cutter 252 and 254 extend outwardly from the upper cam member 278. This lateral movement of the side cutters 272 and 274 is actuated by rotational movement of the upper cam member 278 relative to the lower cam member 280. The lower cam member 280 is fixedly mounted to the inner sleeve 282, as with a setscrew 283 while the upper cam member 278 abuts against the end 284 of the sleeve 282 and can freely rotate relative to the inner sleeve 282 and the upper lower member 280. This allows the upper cam member 278 to be rotated relative to the lower cam member 280 from a first position in which the cutting elements 272 and 274 are in a retracted state to a second position, as shown in FIG. 8B, in which the cutting elements 272 and 274 are fully extended. Reversing the direction of the drill to which the adapter 270 is attached will reverse the movement of the cutting elements 272 and 274. As the lower cam member 280 is rotated in a clockwise direction, the base portions of the cutting elements 272 and 274 that engage corresponding grooves in the lower cam member slide along the grooves. The upper cam member 278 is provided with recesses that allow for lateral movement of the cutting elements 272 and 274 relative thereto, but that prevents any substantial movement of the cutting elements 272 and 274 in a rotational direction relative to the upper cam member 258. The cutting portions of the cutting elements 272 and 274 are housed within the upper cam member 278, which also prevents rotational movement of the cutting elements 272 and 274 relative to the upper cam member 278 while allowing the cam members to move laterally outward.

Figure 9B:
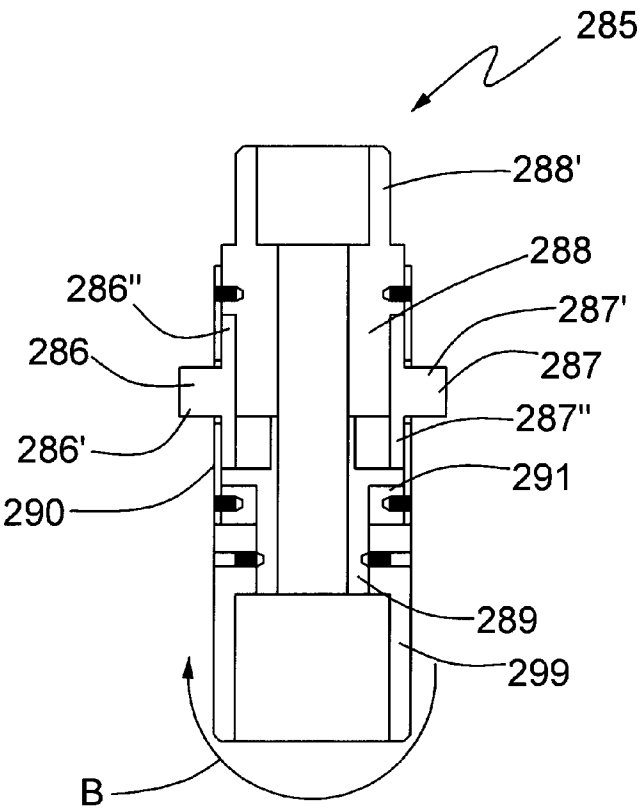
FIGS. 9A and 9B are cross-sectional side views of still another embodiment of a side-cutting adapter in accordance with the principles of the present invention.
Figure 9A:
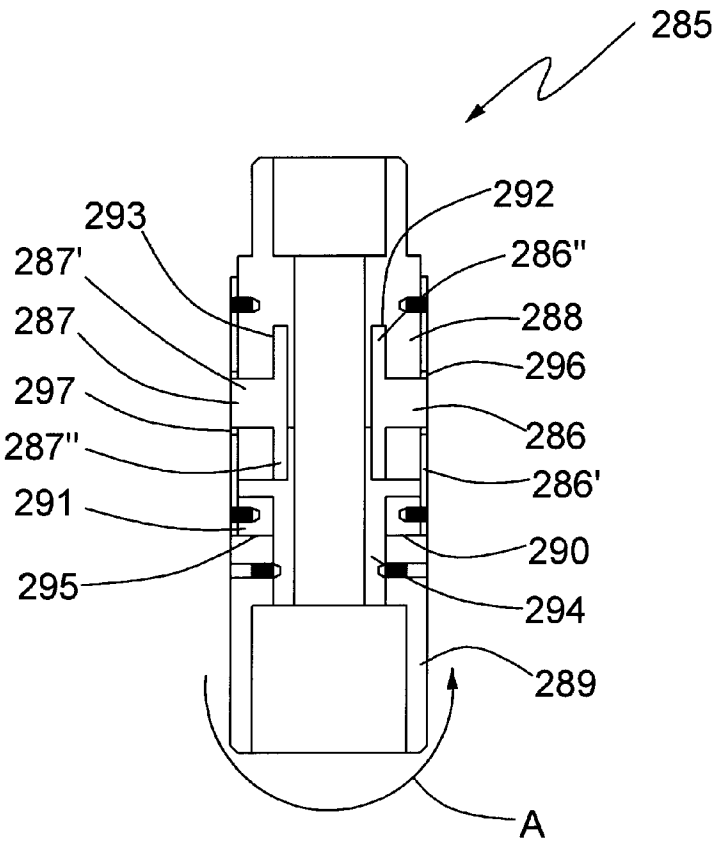

As shown in FIGS. 9A and 9B, a side cutting bit adapter, generally indicated at 285, is capable of extending and retracting laterally extendable side cutters 286 and 287 from a retracted position shown in FIG. 9A to a second extended position shown in FIG. 9B where at least a portion of each cutter 286 and 287 extend outwardly from an upper cutter guide member 288. This lateral movement of the side cutters 286 and 287 is actuated by rotational movement of the upper guide member 288 relative to a lower cutter guide member 289. The lower guide member 289 is rotatably coupled to the upper guide member 288 with outer sleeve 290. Outer sleeve 290 is fixedly coupled to the upper guide member 288, as with threaded fasteners, and rotatably coupled to the lower guide member 289 as with ring bearing 291 to which is fixedly attached. The ring bearing 291 may be of a ball bearing or surface bearing type. The ring bearing 291 abuts against the lower guide member 289 and holds it against the upper guide member 288 while allowing the lower guide member 289 to rotate relative to the upper guide member 288. The sleeve 290 includes apertures, which may be lined with bearing surfaces 296 and 297 for receiving and retaining the cutting portions 286' and 297' of the side cutters. The upper guide member 288 is provided with cutter base guiding grooves 292 and 293 that circumferentially extend from an inner radius to an outer radius of the upper guide member 288. The lower guide member 289 is provided with cutter base guide slots 294 and 295 that radially extend from an inner radius to an outer radius in the lower guide member 289. The base portions 286" and 287" of the cutters 286 and 287 are held within the guide slots 294 and 295 and will move to a full inward position when the lower guide member 289 is rotated relative to the upper guide member 288 in the direction of arrow A. Conversely, the base portions 286" and 287" of the cutters 286 and 287 will move to an outward position as shown in FIG. 9B, when the lower guide member 289 is rotated relative to the upper guide member 288 in the direction of arrow B so as to cause the cutting portion 286' and 287' to protrude from the outer sleeve 290. The upper guide member 288 is provided with an attachment portion 288' configured for attachment to a drill bit (as previously described and shown herein) and the lower guide member 289 is fixedly coupled to a drill stem coupler 299 with the drill stem coupler 299 configured for attachment to the distal end of a drill stem (as previously described and shown herein). It should be noted that while the various components are shown as being coupled together with various fastening mechanisms, such as the set screws shown in FIGS. 9A and 9B, other means of attachment may be employed including welding and/or compression fitting. In addition, while some components are illustrated as being formed from separate components that are fixedly coupled, such components could be combined and formed from a single integral component. For example, the outer sleeve 290 and upper guide member 288, outer sleeve 290 and ring bearing 291, and/or lower guide member 289 and drill stem coupler 299 could be integrally formed. Likewise, various components that are shown to be formed from a single integral component could be formed from multiple components that are combined to form a similar structure. As such, reference herein to the term "member" or "structure" is not intended to limit such components or parts to singular integrated components or parts, but could be formed from multiple combined components or parts.

Figures 10A, 10B, 10C, 10D:
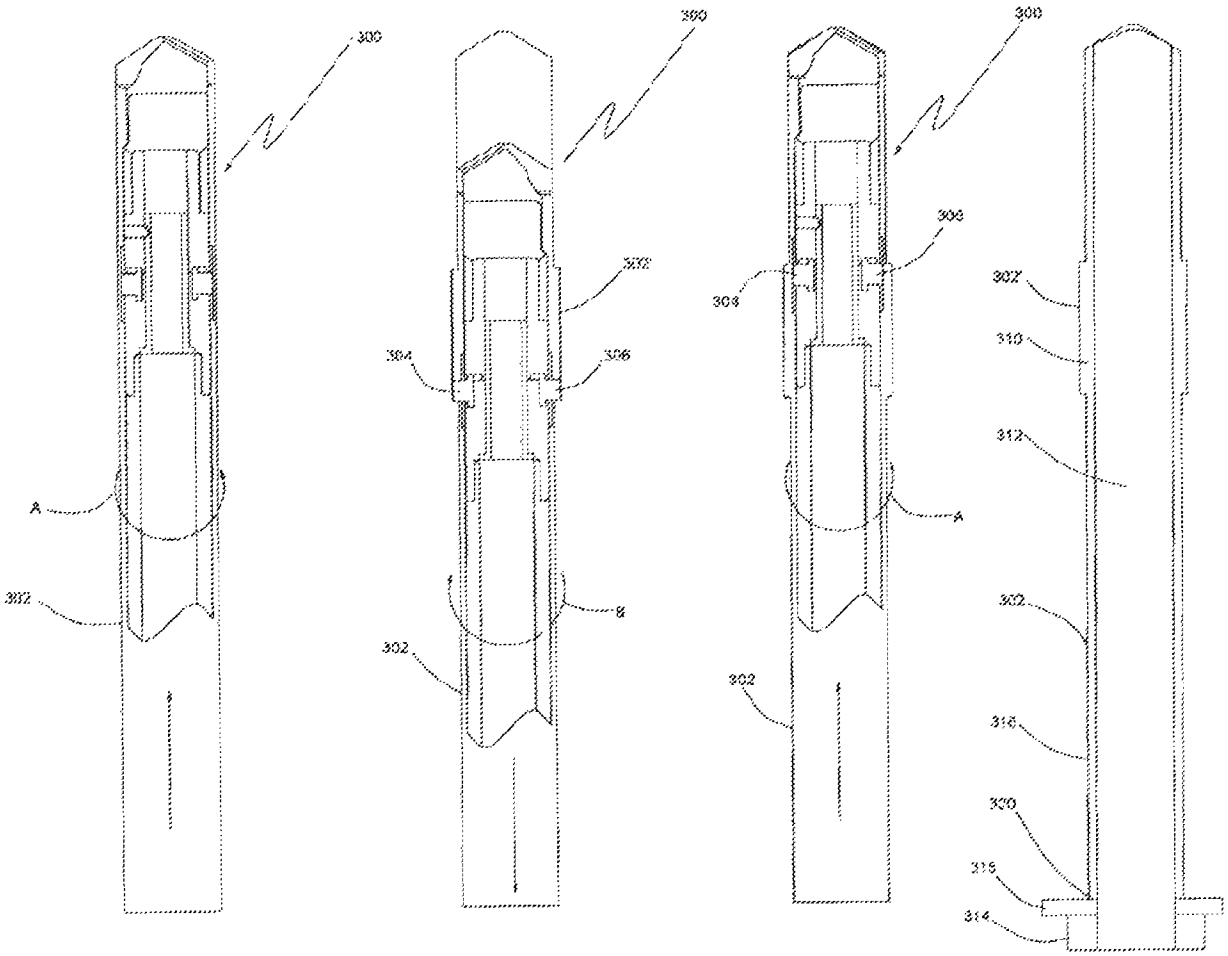
FIGS. 10A, 10B, 10C and 10D are cross-sectional side views of a drill string in accordance with the principles of the present invention in various stages of cutting a borehole according the methods of the present invention.

FIGS. 10A-10D illustrate a process for producing a borehole in an earthen formation having a portion therein with a wider diameter than a portion closer to the exit opening of the borehole. As shown in FIG. 10A, a drill bit assembly, generally indicated at 300, is used to drill a borehole 302 by rotating the drill bit as indicated by arrow A until a desired borehole depth is reached. In this step, the drill bit assembly operates as any other drill bit assembly known in the art for forming a borehole. Once the desired borehole depth is reached, the direction of rotation of the drill bit assembly 300 is reversed as indicated by arrow B as shown in FIG. 10B. After less than a half of a rotation of the drill bit assembly 300, the cutting elements 304 and 306 become fully laterally extended. Continued high speed counter-rotation and partial extraction of the drill bit assembly 300 causes the cutting elements 304 and 306 to engage and cut the side walls of the borehole 302 to create an enlarged diameter section 302'. After a sufficient desired length of the borehole 302 has been widened, as shown in FIG. 10C, the drill bit assembly 300 is again fully reinserted into the borehole 300 and the direction of rotation of the drill bit assembly 300 is once again reversed to be in the direction of arrow A, which causes the cutting elements 304 and 306 to retract. Once retracted, the entire dill string can be removed from the borehole 302. The resulting borehole 302 as shown in FIG. 10D is provided with an enlarged diameter section 302' (shown for illustration purposes to be relatively short in length) that could run a substantial length of the borehole 302. When the resin 310 and roof bolt 312 are inserted into the borehole 302, the resin at least partially fills the enlarged diameter section 302' and bonds to the roof bolt 312. As such, the roof bolt 312 can be tensioned by tightening the head 314 of the bolt 312 against a roof plate 316 (shown to be smaller in scale than is actually the case for illustrative purposes), even in soft or highly fragmented rock formations since the enlarged area of resin is extremely difficult to remove through the remaining smaller diameter portion 318 of the borehole 302 that is nearer the opening 320 of the borehole 302. This makes it virtually impossible for the roof bolt 312 to become dislodged from the borehole 302 resulting in a significantly more stable roof bolt installation and ultimately safer underground mine shafts.

FIGS. 11A-11D illustrate another embodiment of a drill bit assembly, generally indicated at 400 in accordance with the principles of the present invention. The drill bit assembly 400 comprises a drill stem 402, drill bit 404 and side cutting assembly 406. The side cutting assembly 406 is comprised of a first body portion 408 and a second body portion 410, with the first and second body portions 408 and 410 coupled together as by threaded mechanical attachment as illustrated or by other means known in the art, such as press fitting, pinned or set screw connection or by welded connection. The first end 412 of the first body portion 408 is configured for attachment to the distal end of the drill string 402 and the second distal end 414 of the second body portion 410 is configured for attachment to the drill bit 404. The first and second body portions 408 and 410 are fixedly coupled to each other such that rotation of the first body portion 408 by the drill string 402 causes rotation of the second body portion 410 and the drill bit 404. The first body portion 408 defines a cylindrical recessed portion 414 that has a diameter that is less than the diameter of the proximal end 412 of the first body portion. The recessed portion 414 is nonconcentrically oriented relative to a longitudinal axis of the drill bit assembly 400. In other words, the center of the recessed portion 414 is offset relative to the longitudinal axis of the drill bit assembly 400. A cutting sleeve 416 is disposed around the recessed portion 416 and is partially freely rotatable relative thereto between a first position as shown in FIG. 11B and a second position as shown in FIG. 11A. A cutting element 418 is disposed on an outer surface of the sleeve 416. In the first position, the cutting element 418 is in a retracted position and positioned within a recess 420 formed by the recessed portion 416 on one side of the first body 408. When the sleeve is rotated approximately 180 degrees to the second position, the cutting element 418 is rotated to an extended position in which the cutting element 418 extends beyond the outermost surfaces of the first and second bodies 408 and 410 so as to engage a sidewall of a borehole and cut the sidewall upon rotation of the drill bit assembly 404.

Movement of the sleeve 416 from the first position to the second position and back is actuated by the direction of rotation of the drill bit assembly 400. As shown in FIGS. 11C and 11D, the cutting element 418 is provided with a leading edge that provides essentially a cutting tooth that will engage the surface of the sidewall of a borehole when the direction of rotation of the drill bit is reversed. As shown, the cutting element may have a concave leading edge for engaging and cutting a sidewall of a borehole. In a forward direction of rotation for initially drilling the borehole, which may be in a clockwise direction when viewed from the viewpoint of the driller, the tapered top surface 422 of the cutting element 418 will cause a slight impingement of debris in the borehole between the cutting element 418 and the sidewall of the borehole. This will force the sleeve 416 to rotate to the extent possible in a counter-clockwise direction relative to a clockwise direction of rotation of the drill bit 404. This will cause the cutting element 418 to be positioned as shown in FIGS. 11B and 11D.

When the direction of rotation of the drill bit is reversed, the leading edge 424 of the cutting element 418 will engage and grab the sidewall of the borehole causing the sleeve to rotate from the first position shown in FIGS. 11B and 11D to a second position shown in FIGS. 11A and 11C. The rotation of sleeve 416 is limited to approximately 180 degrees relative to the first body 408 by the engagement of a spherical bearing 426 that is interposed between the first body portion 408 and the sleeve 416. A stepped radial surface 428 is circumferentially provided on the first body portion proximate the second body portion 410. A semicircular groove is disposed in the surface 428 and extends slightly more than 180 degrees around the first body 408 within the recessed portion 414. The sleeve 416 is provided with an inwardly extending shelf 430 at one end thereof that is positioned over the surface 428. The shelf 430 has an inner surface that defines a second semicircular groove for receiving a portion of the bearing 426. Again the second groove extends circumferentially along the shelf 430 approximately slightly more than 180 degrees. The shelf portion 430 of the sleeve 416 has a longitudinal thickness that extends between the surface 426 and the proximal end 432 of the second body portion 410 so as to abut against the second body portion and to be held between, but freely rotatable to a certain extent, between the first and second body portions 408 and 412. Engagement of the bearing 426 with the ends 434 and 436 of the groove 438 in the first body portion 408 and the ends of the groove 442 in the sleeve 416 will allow limited free rotation of the sleeve 416 relative to the first and second bodies 408 and 412 between the first and second positions as illustrated.

FIGS. 12A-12D illustrate another embodiment of a drill bit assembly, generally indicated at 500 in accordance with the principles of the present invention that has a configuration similar to the drill bit assembly 400 illustrated in FIGS. 11A-11D. In this illustrated embodiment, rotation of the sleeve 516 relative to the first body portion 508 is limited by direct engagement between the sleeve 516 and the first body portion 508. The distal end 509 of the first body portion 508 is provided with a stepped surface 528 in which the height of the surface 528 varies around the circumference of the first body 508 at the distal end 509 at the recessed portion 520. The sleeve 516 includes an inwardly depending shelf or wall 530 that has a portion 531 that is thicker. This thicker portion resides within the lower portion 529 of the stepped surface 528 and can slide relative thereto between the ends 533 and 535 of the lower portion 529. Movement between these two positions of the sleeve 516 causes approximately 180 degrees of rotation of the cutting element 518 relative to the body 508 to move the cutting element 518 from a cutting position shown in FIGS. 12A and 12C to a non-cutting or retracted position shown in FIGS. 12B and 12D.

FIGS. 13A-13D illustrate yet another embodiment of a drill bit assembly, generally indicated at 600 in accordance with the principles of the present invention. The drill bit assembly 600 includes a bit 602 and stem 604 and side cutting assembly 606. The side cutting assembly 606 has a first portion 608 configured for attachment to the bit 602 and a second portion 610 configured for attachment to the stem 604. The first portion 608 and second portion 610 are coupled together, as by a threaded connection 612 or other means of mechanical fastening known in the art. The side cutting assembly 606 includes a central, longitudinally extending aperture or bore 614 that is in fluid communication with the ends 616 and 618 of the side cutting assembly 606. A pair of side cutting elements 620 and 622 is pivotally coupled to the body of the side cutting assembly 606. More specifically, recesses 624 and 626 are formed in the outer surface 628 of the second portion 610 for housing the side cutting elements 620 and 622. Retaining pins 630 and 632 are positioned within longitudinally extending boreholes that are in communication with the recesses 624 and 626, respectively, to pivotally retain one end of a respective cutting element 620 and 622. As such, while one end of each cutting element 620 and 622 is pivotally held within a respective recess 624 and 626, the cutting end of each cutting element 620 and 622 can radially and outwardly extend from the second portion 610. The retaining pins 630 and 632 are held within their respective bore holes 631 and 633 by engagement of the first portion 608 with the second portion 610 such that the proximal end 634 of the first portion 608 abuts against the distal end 636 of the second portion 610 and the distal ends of the retaining pins 630 and 632.

Figure 13A:
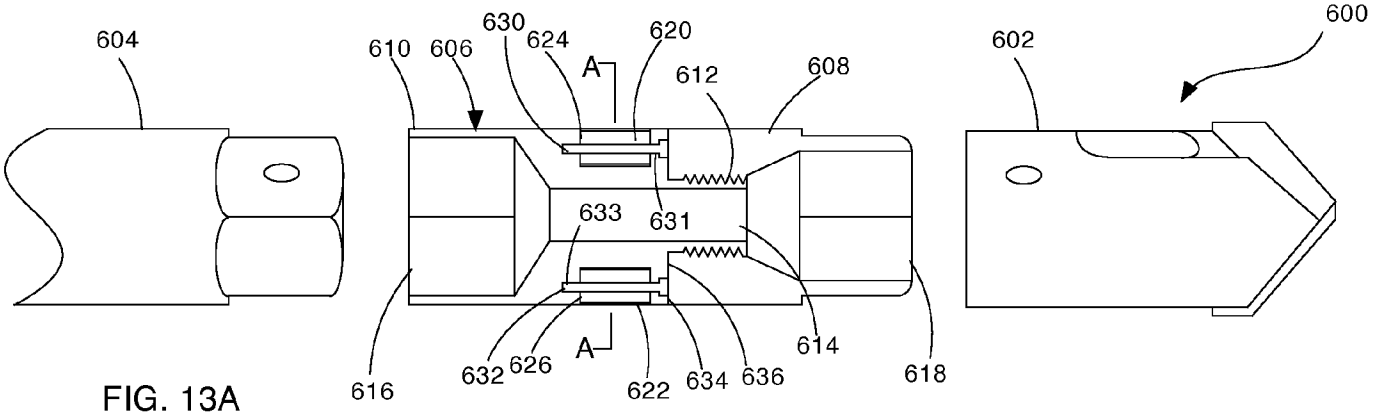
FIGS. 13A, 13B, and 13C are cross-sectional views of still another embodiment of a drill bit and a drill bit adapter in accordance with the principles of the present invention.
Figure 13B:
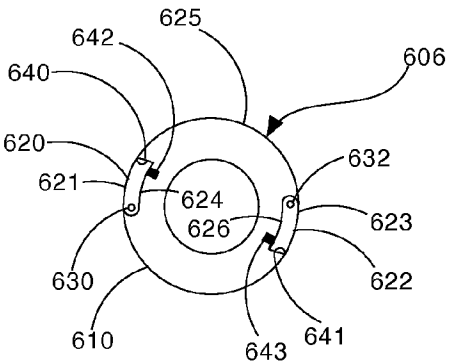
Figure 13C:
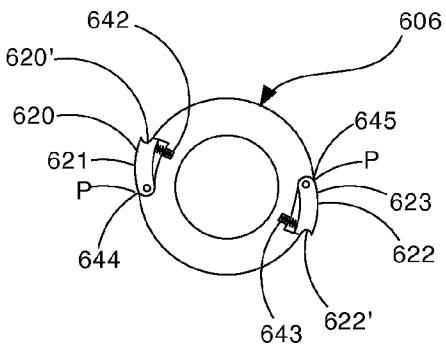

Referring specifically to FIGS. 13B and 13C, each cutting element 620 and 622 can pivot from a first recessed position as shown in FIG. 13B to a second radially extended position as shown in FIG. 13C. The cutting elements 620 and 622 have a generally crescent shape that substantially matches the crescent shape of the respective recess 624 and 626 so that when the cutting elements 620 and 622 are fully recessed as shown in FIG. 13B, the outer surfaces 621 and 623 substantially match the radius of the outer surface 625 of the second portion 610. The pivoting end of each cutting element 620 and 622 has a radius that substantially matches the radius of the respective recess 624 and 626 at the pivoting end.

The opposite or cutting end 640 and 641 of each cutting element 620 and 622, respectively, defines an effective radius that is substantially the same as the radius of a circle with its center at the center of the respective retaining pin 630 and 632. The adjacent surface of each recess 624 and 626 has a similar curvature. This allows the cutting end of each cutting element 620 and 622 to pivot out of each recess 624 and 626 while maintaining close proximity to the adjacent surface of the respective recess 624 and 626 to prevent debris generated while cutting from impinging the movement of the cutting elements from the retracted position to the radially extended position and back to the retracted position during each side cutting operation as herein previously described with reference to other embodiments of the invention. In addition, each cutting element 620 and 622 is provided with a concave cutting surface 620' and 622' on the cutting end 640 and 641 that forms a cutting edge for cutting rock from a borehole when the cutting elements are extended as shown in FIG. 13C.

Each cutting element 620 and 622 pivots about its respective retaining pin 630 and 632 and is outwardly biased by respective spring members 642 and 643, such as a coil spring or other biasing devices known in the art. When the side cutting assembly 606 is rotated in a first direction, in this example counter-clockwise when being viewed from the down hole position as illustrated in FIG. 13B, the side cutting elements 620 and 622 are forced into their recessed position by the engagement of the side wall of the borehole being drilled with the outer surfaces 621 and 623 of each cutting element 620 and 622.

As specifically illustrated in FIG. 13C, when the rotation of the side cutting assembly 606 is reversed, the force of the springs 642 and 643 cause the cutting elements 620 and 622 to pivot outwardly until the point P at which the radius of the retained end of the cutting element 620 and 622 changes abuts against the respective adjacent surface 644 and 645 of the second portion 610 to prevent further rotation of the cutting elements 620 and 622. In this position, the concave cutting surfaces 620' and 622' are substantially fully exposed so that side wall cutting swill be generated to increase the down hole bore diameter of the borehole being cut. Essentially, the exposed cutting surfaces 620' and 622' form teeth that engage the side wall of the borehole so that, when combined with the spring force being applied to each cutting element 620 and 622, they cause the cutting elements 620 and 622 to stay in the radially extended position so long as the side cutting assembly is being rotated in a clockwise direction when viewed from the down hole position as shown in FIG. 13C. Reversal of the rotation of the side cutting assembly in a down hole location will cause the side cutting elements 620 and 622 to retract so that the tool can be retracted from the borehole after a desired length of an enlarged down hole bore size has been cut.

FIGS. 14A-14E illustrate yet another embodiment of a of a drill bit assembly, generally indicated at 700 in accordance with the principles of the present invention. The drill bit assembly 700 includes a bit 702 and stem 704 and side cutting assembly 706. The side cutting assembly 706 has a first portion 708 configured for attachment to the bit 702 and a second portion 710 configured for attachment to the stem 704. The first portion 708 and second portion 710 are coupled together with a longitudinally extending sleeve 712 that is fixedly coupled to the first portion 708 and rotatably coupled to the second portion 710. The sleeve 712 is held relative to the first portion with a setscrew 714. The proximal end 716 of the sleeve 712 includes a circumferential flange 718 that abuts against an inside toroidal recess 720. The sleeve 712, and more particularly the flange 718 interconnects the first portion 708 to the second portion 710 in a manner in which the second portion 710 can rotate relative to the first portion 708.

The first and second portions 708 and 710 also include internal abutment surfaces 722 that are positioned with a circumferential groove 724 that partially extends around the sleeve 712 to limit the amount of rotation between the first and second portions 708 and 710. As such, the forces encountered during drilling and retraction by the side cutting assembly 706 are transferred between the first and second portions 708 and 710 by the abutment surfaces 722 and not necessarily by the cutting elements or cutting element actuation members as hereinafter described.

Figure 14A:
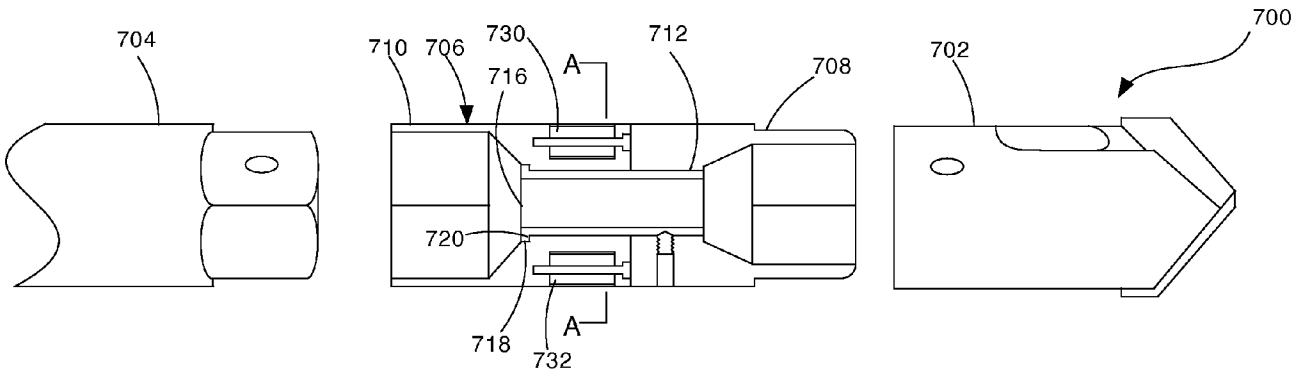
FIGS. 14A, 14B, 14C, 14D and 14E are cross-sectional views of yet another embodiment of a drill bit and a drill bit adapter in accordance with the principles of the present invention.
Figure 14B:
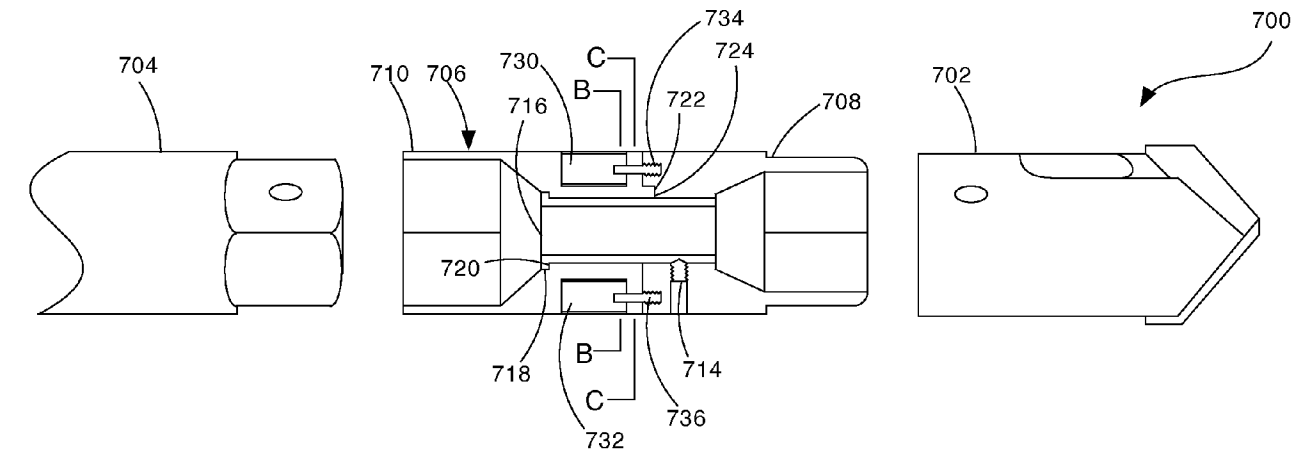
Figure 14E:
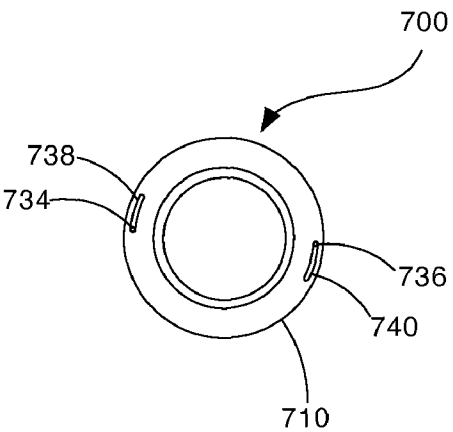
Figure 14D:
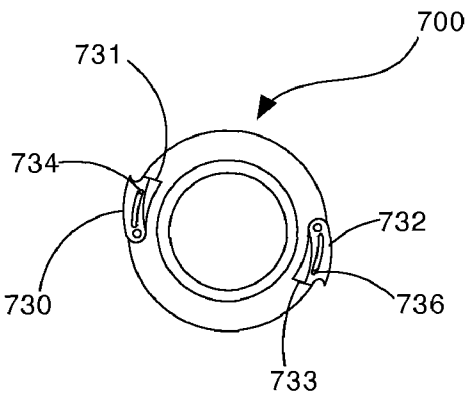
Figure 14C:
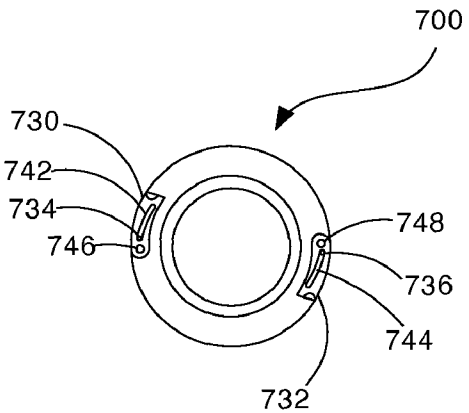

The side cutting assembly 706 includes two side-cutting elements 730 and 732. The side cutting elements 730 and 732 reside within recesses 731 and 733, respectively, formed in the outer sidewall of the second portion 710. The recesses 731 and 733 have a shape and size that substantially matches a shape and size of the cutting elements 730 and 732 so that debris generated from the cutting process is less likely to impinge movement of the cutting elements 730 and 732 from a first retracted position as shown in FIG. 14C to a second extended position as shown in FIG. 14D. The cutting elements 730 and 732 and associated recesses 731 and 733 are configured similarly to the cutting elements and recesses illustrated in FIGS. 13A-13C. Rather than being outwardly biased with a spring or other biasing element, however, the cutting elements 730 and 732 are actuated between the first and second positions as a result of relative rotational movement of the first portion 708 and the second portion 710.

Actuation members 734 and 736 (see also FIG. 14B) are fixedly coupled to the first portion 708 and longitudinally extend through respective crescent shaped slots 738 and 740 formed in the second portion 710 at the interface between the first and second portions 708 and 710 as shown in FIG. 14C. The actuation members 734 and 736 engage with corresponding curved slots 742 and 744 formed in the cutting elements 730 and 732, respectively. The curved slots are oriented so that the end of the slot closest to the retaining pins 746 and 748 about which the respective cutting elements 730 and 732 pivot is at a greater radial distance than the opposite end of the curved slot. As the first and second portions 708 and 710 rotate relative to one another, the actuating members 734 and 736 move along the curved slots 742 and 744, respectively, to extend or retract the cutting elements 730 and 732 depending on the direction of relative rotation. As such, during a drilling operation, when the drill bit 702 is driven into a formation, the first and second portions 708 and 710 are rotated and/or held in a position in which the cutting elements 730 and 732 are retracted as shown in FIG. 14C. When the rotation of the drill stem 704 is reversed and the drill bit 702 is held against the bottom of a borehole that has been formed, the second portion 710 will rotate relative to the first portion 708 about the sleeve 712 until the cutting elements 730 and 732 are fully extended as shown in FIG. 14D to allow the cutting elements 730 and 734 to widen the diameter of the borehole that has been cut. As the drill bit assembly 700 is retracted while being rotated in the opposite direction, the cutting elements 730 and 732 will form a down hole borehole that is wider than the remainder of the borehole that is closer to the exit of the borehole. Reversing the rotation of the drill bit assembly 700 back to the original direction of rotation used for the initial borehole formation will cause the second portion 710 to rotate relative to the first portion 708 causing the cutting elements 730 and 734 to retract back into the second portion 710 so that the drill bit assembly 700 can be fully retracted form the borehole.

While not specifically illustrated herein, the present invention will have other applications where it is desirable to secure an anchoring system of some design into an earthen borehole. Thus, while the present invention has been described with reference to certain illustrative embodiments to illustrate what is believed to be the best mode of the invention, it is contemplated that upon review of the present invention, those of skill in the art will appreciate that various modifications, combinations and other adaptations may be made to the present embodiments without departing from the spirit and scope of the invention as recited in the claims. It should be noted that reference to the terms "ground anchor" or "anchoring system" in the specification and claims is intended to cover all types of devices used attach to or to secure or retain earthen formations, without limitation. Indeed, as discussed the drilling apparatus of the present invention may have particular utility in many different applications where it is desirable to secure an object into a hole drilled into a rock, cement or other hard formation. The claims provided herein are intended to cover such modifications, adaptations and combinations and all equivalents thereof. Reference herein to specific details of the illustrated embodiments is by way of example and not by way of limitation.

What is claimed is:

1. An apparatus for forming a borehole in an earthen formation having a side cutting assembly comprising;

a longitudinally extending body having a first body portion with a first end configured for coupling to a drill bit and a second body portion having a second end configured for coupling to a drill stem, the body having an outer surface defining a first and a second recess each configured for at least partially receiving a side cutting element therein;

a first side cutting element at least partially disposed within the first recess, the first side cutting element being movable from a first retracted position within the first recess to a second extended position at least partially extending from the first recess;

a second side cutting element at least partially disposed within the second recess, the second side cutting element being movable from a first retracted position within the second recess to a second extended position at least partially extending from the second recess, the first and second cutting elements each have a cutting edge defining a concave cutting surface that is exposed when the respective cutting element is in the second extended position and retracted within the recess when the respective cutting element is in the first retracted position;

first and second retaining pins disposed within the first and second recesses, respectively, the first and second cutting elements being rotatably coupled to the first and second retaining pins;

whereby rotation of the side cutting assembly in a first direction causes the first and second side cutting elements to be positioned in the first retracted position and rotation of the side cutting assembly in a second opposite direction causes the first and second side cutting elements to be positioned in the second extended position in which the first and second side cutting elements can cut a borehole diameter that is increased to a diameter that is defined by an effective diameter of the first and second side cutting elements in the second extended position.

2. The apparatus of claim 1, wherein the first and second cutting elements are pivotally coupled proximate a first end relative to the first and second recesses, respectively and a second end defining a cutting surface that is exposed for cutting a sidewall of a borehole when in the second extended position.

3. The apparatus of claim 2, wherein the first and second portions of the body can rotate relative to one another between a first rotational position and a second rotational position and further comprising first and second actuating members disposed between the first and second body portions, the first and second cutting elements each defining an arcuate shaped slot therein, the first and second retaining members engaging with a respective arcuate shaped slot, whereby relative rotation of the first and second body portions cause the retaining members to move along the respective arcuate shaped slot causing the first and second cutting elements to pivot between the first retracted position and the second extended position depending on a direction of relative rotation between the first and second portions of the body.

4. The apparatus of claim 3, wherein the first and second body portions define a central, longitudinally extending aperture and wherein the first and second body portions are rotatably coupled relative to one another by a sleeve disposed within the aperture, the first body portion being fixedly coupled to the sleeve and the second body portion being retained relative to the first body portion by the sleeve and being rotatable about the sleeve.

5. The apparatus of claim 3, wherein the arcuate shaped slot of each of the first and second cutting elements is oriented with a first end at a first radial distance from a center of the body and a second end at a second radial distance from the center of the body that is less than the first radial distance when the respective first and second cutting elements are in the first retracted position.

6. The apparatus of claim 5, wherein the arcuate shaped slot of each of the first and second cutting elements is oriented with the first end at a radial distance that is substantially equal to the radial distance of the second end of the arcuate shaped slot when the respective first and second cutting elements are in the second extended position.

7. The apparatus of claim 1, wherein the first and second cutting elements are outwardly biased relative to the respective first and second recesses.

8. The apparatus of claim 7, further comprising first and second biasing elements at least partially disposed within the first and second recesses, respectively, for biasing the first and second cutting elements in an outward direction.

9. The apparatus of claim 1, wherein the first and second recesses include at least one abutment surface therein for engaging with the respective first and second cutting element to limit an amount of pivoting of the first and second cutting elements relative to the respective first and second recesses.

10. The apparatus of claim 1, wherein the first and second cutting elements each have an arcuate shaped surface along a distal end thereof adjacent the concave cutting surface, the arcuate shaped surface having a radius that is approximately defined by a distance from the retaining pin to the distal end and wherein the first and second recesses have an inner surface adjacent the distal ends of the first and second cutting elements to substantially match the curvature of the arcuate shaped surfaces, the arcuate shaped surfaces being positioned within the respective recess when the respective first and second cutting element is pivoted between the first and second positions.

11. The apparatus of claim 1, wherein the first and second retaining pins are positioned with respective boreholes formed in the second body portion and are held in place by the proximal end of the first body portion.

12. The apparatus of claim 1, wherein the first cutting element has a leading edge that is spaced radially farther from the longitudinal axis of the body than a trailing edge of the at least one cutting element to cause the at least one cutting element to engage the sidewall of the borehole when the longitudinally extending body is rotated in the second opposite direction to cause first cutting element to engage and cut a sidewall of a borehole.

13. An apparatus for forming a borehole in an earthen formation having a side cutting assembly comprising;

a longitudinally extending body having a first body portion with a first end configured for coupling to a drill bit and a second body portion having a second end configured for coupling to a drill stem, the body having an outer surface defining a first and a second recess each configured for at least partially receiving a side cutting element therein, the first and second portions of the body being rotatable relative to one another between a first rotational position and a second rotational position;

a first side cutting element at least partially disposed within the first recess, the first side cutting element being movable from a first retracted position within the first recess to a second extended position at least partially extending from the at least one recess;

a second side cutting element at least partially disposed within the second recess, the second side cutting element being movable from a first retracted position within the second recess to a second extended position at least partially extending from the second recess, the first and second cutting elements each pivotally coupled proximate a first end relative to the respective first and second recesses and a second end defining a cutting surface that is exposed for cutting a sidewall of a borehole when in the second extended position; and first and second actuating members disposed between the first and second body portions, the first and second cutting elements each defining an arcuate shaped slot therein, the first and second retaining members engaging with a respective arcuate shaped slot, whereby relative rotation of the first and second body portions cause the retaining members to move along the respective arcuate shaped slot causing the first and second cutting elements to pivot between the first retracted position and the second extended position depending on a direction of relative rotation between the first and second portions of the body;

whereby rotation of the side cutting assembly in a first direction causes the first and second side cutting elements to be positioned in the first retracted position and rotation of the side cutting assembly in a second opposite direction causes the first and second side cutting elements to be positioned in the second extended position in which the first and second side cutting elements can cut a borehole diameter that is increased to a diameter that is defined by an effective diameter of the first and second side cutting element in the second extended position.

14. The apparatus of claim 13, further comprising first and second retaining pins disposed within the first and second recesses, respectively, the first and second cutting elements being rotatably coupled to the first and second retaining pins.

15. The apparatus of claim 13, wherein the first and second cutting elements each have a cutting edge defining a concave cutting surface that is fully exposed when the respective cutting element is in the second extended position and fully retracted within the recess when the respective cutting element is in the first retracted position.

16. The apparatus of claim 13, wherein the first and second cutting elements each have an arcuate shaped surface along a distal end thereof adjacent the concave cutting surface, the arcuate shaped surface having a radius that is approximately defined by a distance from the retaining pin to the distal end and wherein the first and second recesses have an inner surface adjacent the distal ends of the first and second cutting elements to substantially match the curvature of the arcuate shaped surfaces, the arcuate shaped surfaces being positioned within the respective recess when the respective first and second cutting element is pivoted between the first and second positions.

17. The apparatus of claim 13, wherein the first and second body portions define a central, longitudinally extending aperture and wherein the first and second body portions are rotatably coupled relative to one another by a sleeve disposed within the aperture, the first body portion being fixedly coupled to the sleeve and the second body portion being retained relative to the first body portion by the sleeve and being rotatable about the sleeve.

18. The apparatus of claim 14, wherein the first and second retaining pins are positioned with respective boreholes formed in the second body portion and are held in place by the proximal end of the first body portion.

19. The apparatus of claim 13, wherein the arcuate shaped slot of each of the first and second cutting elements is oriented with a first end at a first radial distance from a center of the body and a second end at a second radial distance from the center of the body that is less than the first radial distance when the respective first and second cutting elements are in the first retracted position.

20. The apparatus of claim 19, wherein the arcuate shaped slot of each of the first and second cutting elements is oriented with the first end at a radial distance that is substantially equal to the radial distance of the second end of the arcuate shaped slot when the respective first and second cutting elements are in the second extended position.

21. An apparatus for forming a borehole in an earthen formation having a side cutting assembly comprising;

a longitudinally extending body having a first body portion with a first end configured for coupling to a drill bit and a second body portion having a second end configured for coupling to a drill stem, the body having an outer surface defining a first and a second recess each configured for at least partially receiving a side cutting element therein, the first and second portions of the body being rotatable relative to one another between a first rotational position and a second rotational position;

a first side cutting element at least partially disposed within the first recess, the first side cutting element being movable from a first retracted position within the first recess to a second extended position at least partially extending from the at least one recess;

a second side cutting element at least partially disposed within the second recess, the second side cutting element being movable from a first retracted position within the second recess to a second extended position at least partially extending from the second recess; and first and second retaining pins disposed within the first and second recesses, respectively, the first and second cutting elements being rotatably coupled to the first and second retaining pins, the first and second retaining pins positioned with respective boreholes formed in the second body portion and held in place by the proximal end of the first body portion;

whereby rotation of the side cutting assembly in a first direction causes the first side cutting element to be positioned in the first retracted position and rotation of the side cutting assembly in a second opposite direction causes the first side cutting element to be positioned in the second extended position in which the first side cutting element can cut a borehole diameter that is increased to a diameter that is defined by an effective diameter of the first side cutting element in the second extended position.

22. The apparatus of claim 21, wherein the first and second portions of the body can rotate relative to one another between a first rotational position and a second rotational position.

23. The apparatus of claim 22, further comprising first and second actuating members disposed between the first and second body portions, the first and second cutting elements each defining an arcuate shaped slot therein, the first and second retaining members engaging with a respective arcuate shaped slot, whereby relative rotation of the first and second body portions cause the retaining members to move along the respective arcuate shaped slot causing the first and second cutting elements to pivot between the first retracted position and the second extended position depending on a direction of relative rotation between the first and second portions of the body.

24. The apparatus of claim 22, wherein the first and second body portions define a central, longitudinally extending aperture and wherein the first and second body portions are rotatably coupled relative to one another by a sleeve disposed within the aperture, the first body portion being fixedly coupled to the sleeve and the second body portion being retained relative to the first body portion by the sleeve and being rotatable about the sleeve.

* * * * *